United States Patent [19]

O'Lenick, Jr. et al.

[11] Patent Number: 4,830,769

[45] Date of Patent: May 16, 1989

[54] PROPOXYLATED GUERBET ALCOHOLS AND ESTERS THEREOF

[75] Inventors: Anthony J. O'Lenick, Jr., Lilburn; Raymond E. Bilbo, Snellville, both of Ga.

[73] Assignee: GAF Corporation, Wayne, N.J.

[21] Appl. No.: 145,571

[22] Filed: Feb. 1, 1988

Related U.S. Application Data

[63] Continuation-in-part of Ser. No. 11,771, Feb. 6, 1987, Pat. No. 4,731,190, and a continuation-in-part of Ser. No. 89,346, Aug. 25, 1987, abandoned.

[51] Int. Cl.[4] ..... C10M 129/68; C07C 69/34; C07C 43/11; C07C 69/52

[52] U.S. Cl. ..... 252/49.3; 252/52 R; 252/56 S; 252/56 R; 560/127; 560/186; 560/198; 560/224; 560/263; 568/613; 568/622

[58] Field of Search ..... 568/613, 622; 560/127, 560/186, 198, 224, 263; 252/493, 52 R, 56 S, 56 R

[56] References Cited

U.S. PATENT DOCUMENTS

| | | | |
|---|---|---|---|
| 2,425,755 | 8/1947 | Roberts et al. | 252/52 A |
| 2,480,185 | 8/1949 | Fife et al. | 560/263 |
| 2,965,678 | 12/1960 | Sundberg et al. | 568/622 |
| 3,041,281 | 6/1962 | Winsor et al. | 568/622 |
| 3,436,425 | 4/1969 | Stein et al. | 568/613 |
| 3,682,849 | 8/1972 | Smith et al. | 568/622 |
| 3,773,668 | 11/1973 | Denis et al. | 560/198 |
| 4,243,537 | 1/1981 | Knepp et al. | 252/49.3 |
| 4,425,458 | 1/1984 | Lindner et al. | 524/314 |
| 4,453,023 | 6/1984 | McCain et al. | 568/622 |
| 4,533,485 | 8/1985 | O'Conner et al. | 560/198 |
| 4,624,803 | 11/1986 | Balzer et al. | 568/613 |
| 4,689,435 | 8/1987 | Edwards | 568/622 |
| 4,727,199 | 2/1988 | King | 568/622 |

*Primary Examiner*—William R. Dixon, Jr.
*Assistant Examiner*—Jerry D. Johnson
*Attorney, Agent, or Firm*—Marilyn J. Maue; Joshua J. Ward

[57] ABSTRACT

The present invention relates to propoxylated guerbet alcohols and esters having an iodine number less than 7 and defined by the general formula:

which alcohols and esters are useful, individually or in admixture, as lubricants in the working of metals.

23 Claims, 1 Drawing Sheet

PROPOXYLATED GUERBET ALCOHOLS AND ESTERS THEREOF

Figure 1A:
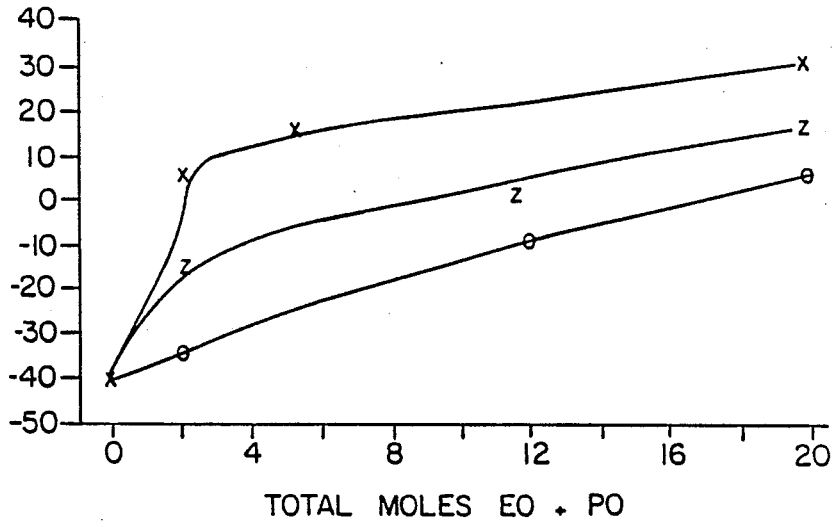

This application is a continuation-in-part of co-pending U.S. Application, Ser. No. 011,771, filed Feb. 6, 1987 entitled "METAL LUBRICANTS" and Ser. No. 089,346, filed Aug. 25, 1987 entitled "GUERBET ALKOXYLATES AND THEIR ESTERS".

In one aspect the invention relates to novel compounds derived from guerbet alcohols. In another aspect the invention relates to the preparation of said novel compounds, and in other aspects to compositions containing said novel compounds and their use as lubricants.

BACKGROUND OF THE INVENTION

It is well known that water insoluble oils such as mineral oil or fatty unsaturated oils are not fully acceptable for working metals from the point of view of cooling efficiency. Early patents like U.S. Pat. No. 3,929,656 to Flis issued Dec. 30, 1975, disclose a typical oil based system made up of 60–90% mineral oil, 5–30% unsaturated fatty oil and 3–15% paraffin oil. Emulsion type lubricants based upon these oils have been used conventionally for plastic deformation processes including but not limited to hot rolling of aluminum, the manufacture of aluminum cans by drawing and ironing, the cold rolling of steel and so forth. These conventional emulsions contain, as an emulsifier, an anionic soap, a nonionic surfactant, e.g., a sorbitol ester of alkoxylated alcohol, and other additives. The products used in these processes are typically liquid at ambient temperatures and are of high molecular weight to allow for the needed lubrication properties. In order to get a lubricating material that is effective and liquid, the products of interest have been based upon unsaturated hydrophobes like oleic, linoleic, and tall oil acids. U.S. Pat. No. 3,945,930 to Sugiyma issued Mar. 23, 1976, discloses a typical emulsion system made up of a nonionic fatty acid ethoxylate, and oil soluble unsaturated fatty triglyceride and a corrosion inhibitor based upon a phosphate ester. U.S. Pat. Nos. 4,042,515 and 4,075,393 describe a dimer acid unsaturated fatty acid ester used in an emulsion system for metal lubrication. Hydrophobic coatings applied to pre-formed aluminum are described in U.S. Pat. No.4,099,989. U.S. Pat. No. 4,243,537, No. 4,362,634 and No. 4,581,152 wherein an unsaturated water dispersible fatty acid alkoxylate and an alkanolamine soap are used in drawing compounds.

While the above materials function fairly well as lubricants, they are subject to oxidation and development of rancidity. Also the double bonds needed for the desired liquidity, are oxidized to lower molecular weight aldehydes, ketones and condensation products which react to form by-products imparting objectionable color, odor and taste. These deleterious results occasioned by by-products, even in minute concentration as low as parts per billion, persist after repeated washings. Such objectionable properties are particularly unacceptable in applications where a beverage or other comestible products are packaged in metal containers which have been formed using such synthetic lubricants during processing. The brewing industry has recenlty introduced a maximum unsaturation level, indicated by iodine value of 3 mg KOH/gram, for any material used as synthetic lubricants during the formation of their metal containers.

It is therefore an object of the present invention to overcome the above lubricant deficiencies and to provide a convenient, efficient and economical process for lubrication during metal forming.

Another object of this invention is to provide a group of compounds having excellent lubricating properties and low levels of unsaturation.

Another object is to provide lubricants of relatively high molecular weight which retain fluidity at temperatures suitable for metal working.

Still another object is to provide a lubricating composition particularly useful in the formation of aluminum cans and sheet metal.

These and other objects of the invention will become apparent from the following description and disclosure.

THE INVENTION

In accordance with the present invention there is provided certain propoxylated guerbet alcohols and esters having the formula

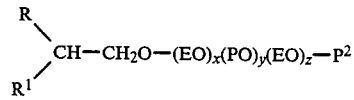

A.

wherein R and $R^1$ are each individually alkyl of from 1 to 20 carbon atoms and the total carbon atoms of $P+R^1$ is at least 4; y has a value of from 1 to 20; the sum of integers x and z is 0 to 20 and $R^2$ is hydrogen, alkyl or $-COR^3$ wherein $R^3$ can be hydrogen, alkenyl, or alkyl which alkyl or alkenyl is unsubstituted or substituted with carboxyl, $COP^5$ or a cyclohexenyl moiety of the formula

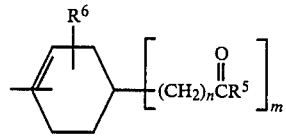

B.

or

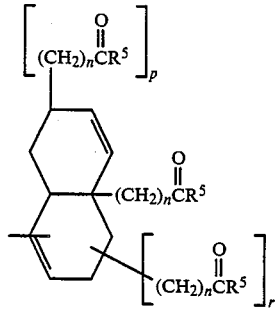

C.

where m has a value of from 1 to 3; n has a value of from 0 to 10; each of p and r has a value of from 0 to 1 and $R^5$ is hydroxy or the alkoxylated guerbet moiety

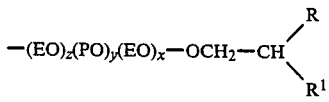

D.

and $R^6$ is alkyl or alkenyl of from 1 to 10 carbon atoms. The above compounds can be employed as lubricants individually or in admixture in an unadulterated state or can be formulated into compositions containing an inert solvent such as for example mineral oil, water, alkoxylated or non-alkoxylated paraffinic oils and esters, etc. The lubricant compositions may also contain up to 50% by weight unreacted guerbet alcohol and Cannizzaro soap by-products based on total guerbet derivative compounds of formula A.

The compounds of formula A are those having low unsaturation indicated by an iodine number less than seven, preferably less than two. The most preferred compounds of the present invention are those which contain no unsaturation and have an iodine number of about zero. The presence of propyleneoxide in the present compounds is critical since it provides a high and needed degree of liquidity to the lubricant and maintains the liquid state at ambient and lower temperatures. Thus, inclusion of propyleneoxide (PO) units provides significantly more liquidity to the guerbet derived product for the same degree of alkoxylation as guerbet derived products alkoxylated with only ethylene oxide (EO). It will be understood that the units of EO and PO are present mainly in block distribution; however they can occur randomly at intervals in the polymer chain. Preferred compounds for use in metal forming are those which contain a significant amount of PO units.

For the purposes of this invention, unless otherwise indicated, temperatures are in degrees C., percentages and ratios are by weight and pressures are in psia. Guerbet alcohols are those having branching on the beta carbon atoms and are defined by the formula

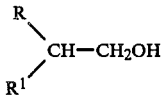

E.

wherein R and $R^1$ are as defined above.

The preferred products of the present invention are those wherein R and $R^1$ are alkyl radicals containing from six to fifteen carbon atoms; y has a value of from 1 to 10, most preferably from 2 to 8; the sum of x+z is 2–20, most preferably 4–10; and the unsaturation in the compound, indicated by iodine value, is less than 2. Although in most cases, the PO moiety may not be in preponderance, its presence in significant amount is critical to liquidity, rinsability and resistance to oxidation in the compound. Also preferred in above formula A., when $R^2$ is an organic radical, said radical contains at least four carbon atoms.

As pointed out above, the present compounds can be employed alone or in formulations as lubricants in the formation, molding and extrusion of metals, thermoplastics and rubber materials such as in the formation of metal containers, the molding of automotive facia, particularly in the formation of automotive bumpers by a RIM process, and in the molding of rubber tires. The operations involved in container formation include cupping, canning, rolling, forging, ironing, drawing, wrinkling, etc. In all of these operations the present compounds perform as external lubricants and may be applied to the metal undergoing deformation or to the mold into which a liquid thermoplastic or rubber is poured to provide rapid and clean release of molded product. An advantage of the present compounds when used in such lubricating operations for molding thermoplastics and rubber is that they perform their function externally and are substantive to the metal mold substrate. Thus, no extraneous and contaminating additives need be added to the liquid formulation for release of the molded product. Generally, it is found that alkoxylation in the lower portion of the above ranges is beneficial for the molding of plastics and rubber.

In one embodiment for the formation of metal containers, particularly aluminum cans, the lubricant is comprised of a mixture of alcohols to form an emulsion having a balanced hydrophobe-lipophobe composition. For example, such an emulsion is formed by combining between about 10% and about 60% water soluble alkoxylated guerbet alcohol containing at least 20% EO; between about 10% and about 40% oil soluble alkoxylated guerbet alcohol and between about 0 and about 20% nonalkoxylated guerbet alcohol. This mixture provides a mineral oil free based system having low viscosity, high rinsability and is particularly beneficial when forming operations slightly above ambient temperature are employed. It will be understood that when the hydrophobe-lipophobe balance (HLB) is high, the material is water soluble; whereas a low HLB indicates an oil soluble material and that the HLB can be altered by the amount of EO incorporated for water solubility.

In another embodiment, the nonalkoxylated component in the above mixture can be employed up to 50%, as when the present product is derived from a guerbet alcohol of lower purity. Unexpectedly, when utilizing such impure guerbet alcohols for alkoxylation and/or subsequent esterification, superior rinsability is achieved. The impurities referred to are the unreacted alcohol in the guerbet reaction which necessarily are of lower molecular weight, e.g. half the number of carbon atoms as are present in the guerbet alcohol product, and Cannizzaro soap by-products. These impurities may occur in admixture with the guerbet alcohol product in an amount of up to about 50% by weight, usually not more than about 30% by weight. Accordingly a preferred composition for metal working incorporates up to 50 weight %, preferably a minor amount, of linear lower molecular weight alcohol, which may become alkoxylated and/or esterified, in whole or in part during the reactions which form the present alkoxylated guerbet products.

An emulsion or solution of the above guerbet alkoxylated product or mixtures thereof can also be formed with a variety of solvents and/or suspension agents which include water, mineral oil, alkoxylated and nonalkoxylated parafinic compounds, ethers, fatty acid ketones, etc. When such dilution is employed, the weight ratio of diluent to product or product mixture is between about 20:1 and about 1:20, preferably between about 10:1 and about 1:10.

Generally the guerbet products of this invention are applied to a metal substrate by spraying, dipping or any other convenient process in an amount sufficient to provide lubrication to the metal surface when in frictional contact with another surface. The specific amount of lubricant applied is dependent upon the individual operation and the processing temperature employed. Accordingly, as little as 0.0001 gram to as much as 3 grams of the present product/kg of metal can be employed. More frequently between about 0.001 and about 1 gram of the present product/kg of metal is employed for the formation of aluminum beverage cans.

The use of the present products as lubricants achieves many beneficial results. Not only are the lubricants highly resistant to oxidation and rancidity but they also retain their liquidity at ambient temperatures. In addition these products display good substantivity to metal surfaces under forming process conditions but are easily removed by rinsing with water to provide a clean metal surface with substantially no oily film residue or spotting. The complete removal of these products by rinsing is highly desirable in the formation of metal containers for comestible products, since they leave no degradable residue for subsequent contamination of the container contents. Such properties are particularly required in the formation of aluminum cans for beverages which are easily tainted by extremely small concentrations of contaminating materials.

The products of this invention are prepared by alkoxylation of the guerbet alcohol starting material which is optionally followed by esterification. The guerbet alcohols and their preparations are well known in the art and require no further exemplification. Preferred species of guerbet alcohols which are employed in the present process include 2-ethyl-hexan-1-ol, 2-hexyl-eicosan-1-ol, 2-hexyl-decan-1-ol, 2-octyl-dodecan-1-ol, 2-butyl-octan-1-ol, 2-decyl-decan-1-ol, 2-myristyl-eicosan-1-ol, 2-capryl-eicosan-1-ol, 2-coco-cocan-1-ol, 2-talow-octadecan-1-ol, isocetyl alcohol, 2-hexadecyl-octadecane-1-ol, etc. These and other guerbet alcohols are alkoxylated by reaction with the amounts of alkyleneoxide desired as units in the product to provide the corresponding alkoxylated guerbet alcohol having the structure

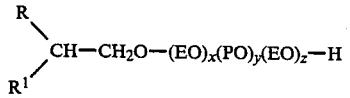

F.

The alkoxylate units introduced into the guerbet molecule comprise propylene oxide units or a mixture of propylene oxide and ethylene oxide units. The alkoxylate units can be introduced in admixture for a more random or heteric distributional structure or the PO and EO units may be added stepwise for more block-like distribution. The alkoxylation process is effected at a temperature of between about 90° and about 200° C., preferably between about 110° and 175° C. under a pressure of from about 2 to about 200 psia, preferably from about 40 to about 60 psia. The exothermic reaction takes place over a period of from about 4 to about 25 hours, more usually from about 5 to about 10 hours, depending upon the efficiency of heat removal and additions of PO and/or EO. The ratio of EO:PO can vary between about 0:1 and about 20:1, preferably between about 1:4 and about 4:1. As indicated above, the product can be completely propoxylated or can contain a mixture of ethylene oxide and propylene oxide units. When a mixture of alkoxylated units are desired, it is preferable to contact the guerbet alcohol first with ethylene oxide and then with propylene oxide in the desired amounts. The ethoxylated-propoxylated guerbet can then be again contacted with an additional amount of EO to provide a typical block-like structure. The alkoxylation reaction is carried out under basic conditions desirably with the addition of potassium hydroxide, sodium hydroxide, sodium methylate, strontium carbonate, etc. in an amount between about 0.05 and about 0.5 weight percent, preferably between about 0.1 and about 0.3 weight percent, based on total reaction mixture. The products of the reaction are recovered by distillation and are employed directly as lubricants or may be converted to the corresponding esters by reaction with suitable esterification agents.

Esterification is affected at a temperature of between about 120° and about 300° C., preferably 140° and about 210° C. under atmospheric or slightly subatmospheric conditions, e.g. 10 mm Hg. The reaction is conducted for a period of form about 2 to about 24 hours, preferably from about 4 to about 12 hours to provide the corresponding esterified product. During the esterification reaction, water is generated which is conveniently removed either by direct distillation or by the use of a binary azeotrope during the process. Suitable esterification agents are exemplified by olefinically unsaturated acids, aromatic carboxylic acids, carboxylic acids, acids containing alkoxy substitution or carboxylic acid substituted with cyclohexene moieties which acids may include monoacids, dimer acids, and trimer acids. Specific examples of the organic acids which may be employed for esterification include acrylic, aconitic, benzoic, toluic, xylic, methacrylic, adipic, butyric, capric, caproic, cinnamic, citraconic, citric, cresotinic, elaidic, glutaric, glycolic, lactic, lauric, levulinic, maleic, malic, malonic, palmitic, phthalic, propionic, salicylic, stearic, suberic, succinic, tartaric, linoleic, oleic, glutaric, pimelic, azelaic, sebacic, naphthalic, trimellitic, propane-tricarboxylic, ethyl dicarboxylic, and myristic acids and mixtures thereof. When di- or triorganic acids are employed, the esterification reaction can be continued until all or a portion of the carboxyl units are converted to the corresponding esters.

The cyclohexenyl acids employed for esterification are defined by the formulae:

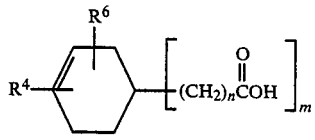

G.

and

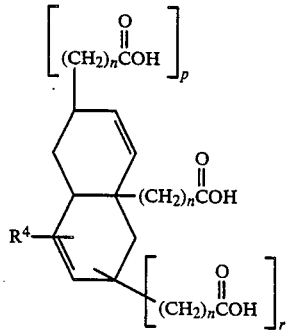

H.

wherein m has a value of from 1 to 3; n has a value of from 0 to 10; $R^4$ is alkyl or alkenyl of from 1 to 15 carbon atoms and each of p and r has a value of 0 to 1. Examples of such cyclohexene substituted alkyl or alkenyl acids include

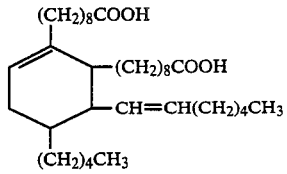

L.

6-(hept-1-enyl)-5-pentyl-3-cyclohexene-1,2-dinonanoic acid

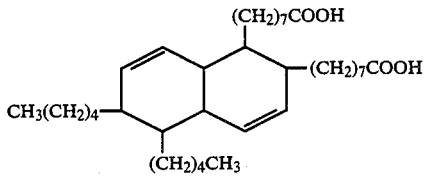

M.

5,6-dibutyl-1,2,4a,5,6,8a-hexahydro-1,2-naphthalene-dioctanoic acid

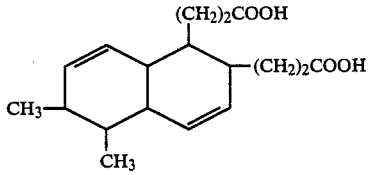

N.

1,2,3,4,4a,5,6,8a-octahydro-5,6-dimethyl-1,2-naphthalene-dipropionic acid. Reactions forming these cyclic compounds from propenyl alcohols usually result in mixtures of acyclic, monocyclic and bicyclic compounds. Thus the reaction of linoleic and oleic acids in the presence of a clay catalyst results in a mixture of compounds L, M and

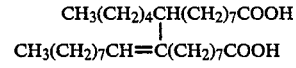

O.

9-nonylidene-10-pentyl-1,18-octadecanedioic acid.

An example of a diacid employed as an esterification agent is illustrated by the reaction of an alkoxylated guerbet alcohol with, for example,

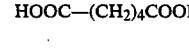

I.

formed by the oxidation of cyclohexanol with nitric acid.

In this case one or both of the carboxyl groups can undergo esterification with the alcohol to provide a mono- or di- ester, depending upon the proportions of acid used in the reaction and the duration of the reaction. Mixtures of such mono- and di- esters are usually obtained. Similarly, the reaction of an alkoxylated guerbet alcohol with the triacid, e.g.

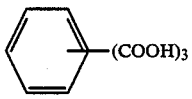

J.

formed by the oxidation of coal with nitric acid, produces mono-, di-, or tri-esters, usually mixtures thereof, since one, two, or three of the carboxyl groups are subject to esterification, depending upon the amount of acid with respect to the alkoxylated guerbet alcohol. Other polycarboxylic acids and their preparations are disclosed in U.S. Pat. Nos. 4,075,393; 4,042,515; 2,482,761; 2,793,219; 3,076,003; and 3,100,784, incorporated herein by reference. Generally, these preparations entail the thermal condensation of unsaturated fatty acids in the presence of a catalyst such as, for example montmorillonite clay.

FIG. 1A shows the effect of propylene oxide in the compounds of the present invention and its ability to retain liquidity at low temperatures. In the graph the melting points of a 2-decyl-decan-1-ol alcohols containing various alkoxylated groups is measured against the total moles of alkoxylated units. Curve X represents an alkoxylated guerbet containing only ethylene oxide. Curve Z represents the guerbet containing 66% EO and 34% PO. Finally, the curve O represents the guerbet containing 50% EO and 50% PO. As shown by comparison of the curves, when a total of 8 moles of alkoxylated units are contained in the various compounds, the guerbet containing 50% PO retains liquidity at temperatures below 0° C., whereas, for the same amount of alkoxylation in the compound containing only EO, the melting point is significantly higher.

Figure 1B:
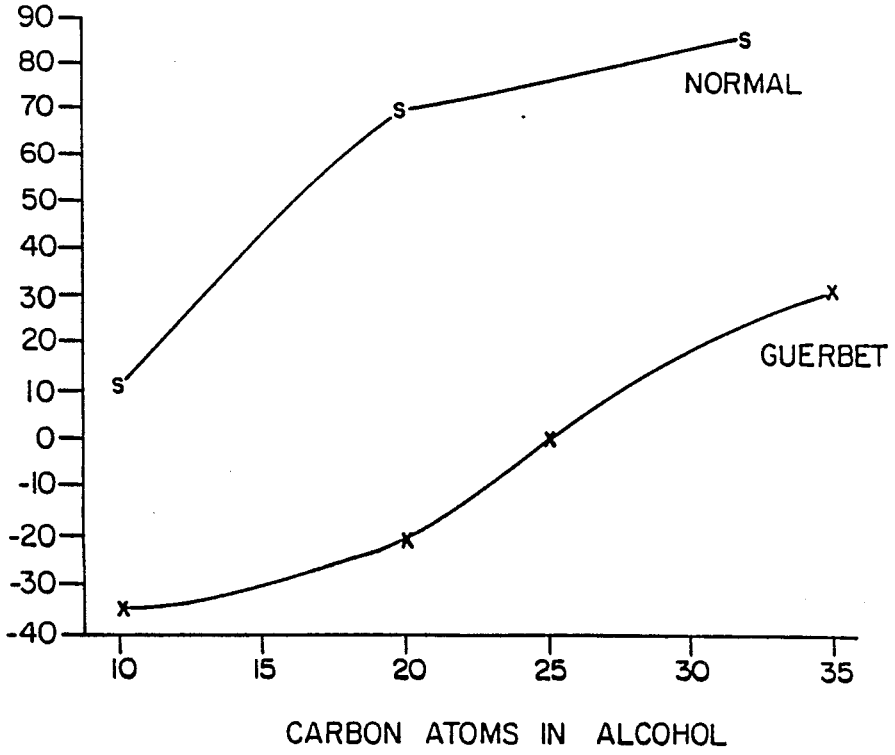

FIG. 1B compares the melting points of normal primary monohydroxy compounds with guerbet alcohols having the same number of carbon atoms. As shown, the guerbet alcohol structure provides liquidity at significantly lower temperatures. Also, the guerbet alcohols have low volatility and low skin irritation properties.

Although all of these compounds are normally liquid, the guerbet containing only EO units is significantly less oxidation resistant and less oil soluble. The low melting points of compounds illustrated by curves Z and O are desired for the reason that they permit easy incorporation into various formulations. This property is unexpected in view of the high molecular weights of these compounds. Thus, high molecular weight contributiong to superior lubricity and ease of fomulation is achieved in the same compound.

U.S. Pat. No. 4,425,458 discloses the use of nonalkoxylated guerbet alcohol diacid esters as plastic lubricants. However, these esters are not useful in the drawing and ironing of metal containers for the reason that they are too hydrophobic. Additionally, the mechanism of plastic lubrication is totally dissimilar from processes involving metal forming. More specifically the plastic lubricating disclosed in the above patent and others is dependant upon its ability to be dissolved in the polymer melt, namely as an internal lubricant. Conversely, in metal formation lubricants are not dissolved but are applied as a thin film to the surface of the metal as an external lubricant to reduce friction. When the present materials are employed as lubricants for the molding of plastics they are not dissolved in the polymer melt but are applied to the surface of the mold for quick release of the molded article. Accordingly the guerbet products of this invention represent many advantages over prior plastic lubricants since they do not introduce extraneous materials into the melt mixture.

Having thus generally described the invention, references now head to the following examples which illustrate preferred embodiments but which are not to be construed as limiting to the scope of the invention as more broadly defined above and in the appended claims.

EXAMPLE 1

To 967 g. of decylalcohol in a 2 liter 4-necked glass reaction flask, 30 g. of sodium hydroxide and 2.0 g. of nickel were added during agitation. The mixture was heated to 230°–250° C. and stirred for 6 hours while water of reaction was removed by distillation. The contents of the reactor was then allowed to cool and product, 2-decyl-decan-1-ol, was recovered in greater than 90% yield. The product, purified by distillation, was identified by gas liquid partition chromatography (GLC).

The general procedure outlined above was employed in all of the following Examples 2–10 inclusive.

EXAMPLE 2

To 510 grams of decyl alcohol and 510 grams of lauryl alcohol was added 20.0 grams of potassium hydroxide and 1.0 grams of zinc, under good agitation. The resulting mixture was heated to between 230° and 250° C. while water generated from the reaction was distilled off.

The reaction progress was followed by GLC analysis and the guerbet alcohol product, 2-lauryl-decan-1-ol, was obtained in greater than 90% yield. The reaction product was then distilled to give a high purity guerbet product.

EXAMPLE 3

To 500 grams of decyl alcohol and 500 grams of octyl alcohol, 30.0 grams of potassium hydroxide and 2.0 grams of nickel were added under good agitation. The resulting mixture was heated to 230°–250° C. while water generated from the reaction was removed by distillation.

Reaction progress was followed by GLC analysis and the guerbet alcohol product, 2-decyl-octan-1-ol was recovered in greater than 90% yield. The reaction product was then distilled for purification.

EXAMPLE 4

To 1000 grams of octyl alcohol, 30.0 grams of potassium carbonate and 1.0 grams of nickel was added under good agitation. The resulting mixture was heated to 220° to 240° C. while under good agitation. Water generated from the reaction was distiled off.

The reaction progress was followed by GLC analysis and the yield of $C_{16}$ guerbet alcohol exceeded 90%. The reaction product is then distilled to give guerbet product in high purity.

EXAMPLE 5

To 967 grams of isodecyl alcohol and 500 tridecyl alcohol, 30.0 grams of sodium hydroxide and 2.0 grams of copper chromite were added, under good agitation. The resulting mixture was heated to between 230° and 250° C. while water generated from the reaction was removed by distillation.

The guerbet alcohol product was recovered in greater than 90% yield. The product was then distilled to provide guerbet product in high purity.

EXAMPLE 6

To 967 grams of coco alcohol ($C_{12-16}$ mixture), 30.0 grams of potassium hydroxide and 2.0 grams of nickel, was added under good agitation. The resulting mixture was heated to between 230° and 250° C. while water generated from the reaction was removed by distillation.

The % conversion to the guerbet product exceeded 90%. The product is then distilled to give product in high purity of $C_{24}$ to $C_{32}$ mixed guerbet alcohols.

EXAMPLE 7

To 967 grams of decyl alcohol, 30.0 grams of potassium hydroxide and 2.0 grams of nickel, were added under good agitation. The resulting mixture was heated to between 230° and 250° C. while water generated from the reaction was removed by distillation.

The reaction progress was followed by GLC analysis. When the amount of 2-decyl-decan-1-ol achieved a yield of 60%, the reaction mixture was cooled and filtered to recover a product mixture containing the guerbet alcohol and unreacted decyl alcohol.

EXAMPLE 8

To 500 grams of decyl alcohol and 500 grams of lauryl alcohol, 30.0 grams of potassium hydroxide and 2.0 grams of zinc powder, was added under good agitation. The resulting mixture was heated to 230°–250° C. while water generated from the reaction was distilled off.

Reaction progress was follwed by GLC analysis. When the guerbet product yield achieved 75%, the reaction was cooled and filtered to recover product 2-lauryl-decan-1-ol and unreacted decyl and lauryl alcohols.

EXAMPLE 9

To 500 grams of decyl alcohol and 500 grams of octyl alcohol, 30.0 grams of sodium hydroxide and 2.0 grams of nickel, were added under good agitation. The resulting mixture was heated to 230°–250° C., while water generated from the reaction was distilled off.

Reaction progress was followed by GLC analysis. When the guerbet of 2-octyl-decan-ol reached 70%, the reaction is cooled and product containing guerbet alcohol and unreacted octyl and decyl alcohol was recovered.

EXAMPLE 10

To 1000 grams of octyl alcohol 30.0 grams of potassium hydroxide and 2.0 grams of nickel were added under good agitation. The resulting mixture was heated to 230°–250° C. while water generated from the reaction was separated from the refluxing alcohol and removed from the reaction mass. Refluxing alcohol was then recycled to the reactor.

Reaction progress was followed by GLC analysis. When the yield of $C_{16}$ guerbet alcohol was 80%, the reaction was cooled and the guerbet product with unreacted octyl alcohol was recovered.

EXAMPLE 11

A. To 748.5 g. of the guerbet alcohol of Example 1, 2 g. of KOH and 249 g. of ethylene oxide was added over a period of 2 hours. An exothermic reaction ensued and the mixture attained a temperature of 125° C. under 45 psig. The ethoxylated product was stripped under vacuum and then cooled and recovered as product A.

B. To 748.5 g. of the guerbet alcohol of Example 2, 2 g. of KOH and 500 g. of ethylene oxide was added over a period of 2 hours. The ensuing exothermic reaction attained a temperature of 180° C. under 50 psia. The ethoxylated product was stripped under vacuum, cooled and recovered as product B.

C. To 748.5 g. of the ethoxylated guerbet alcohol of Example 11A., 2 g. of KOH and 250 g. of propylene oxide was added over a 2 hour period. Then 250 g. of ethylene oxide was added over a similar period. The exothermic reaction reached a temperature of about 175° C. The ethoxylated-propoxylated-ethyloxylated product of primarily block distribution was stripped under vacuum, cooled and recovered as product C.

D. The procedure followed in the preparation of product B was repeated except that the guerbet alcohol of Example 1 was substituted for that of Example 2. 500 g. of propylene oxide was substituted for 500 g. of ethylene oxide. The resulting propoxylated product was recovered as product D.

E. The procedure followed in the preparation of product C was repeated except that the guerbet alcohol was initially contacted with 500 g. of ethylene oxide followed by 500 g. of propylene oxide and the final contact with ethylene oxide was eliminated. Further the guerbet alcohol of Example 2 was substituted for the ethoxylated guerbet alcohol of Example 11A. The resulting ethoxylated-propoxylated product of block distribution was recoverd as product E.

F. To 748.5 g. of the guerbet alcohol of Example 1, 2 g. of KOH and a blend of 250 g. of ethylene oxide and 250 g. of propylene oxide was added over a 2 hour period. The exothermic reaction reached about 170° C. The ethoxylated-propoxylated product of heteric alkoxylated distribution was stripped under vacuum, cooled and recovered as product F.

The properties of the above products A–F were evaluated on a scale of from 1 (poor) to 5 (excellent). The results of these evaluations are as reported in the following Table I.

TABLE I

| Lubricating Properties | Products A | B | C | D | E | F |
|---|---|---|---|---|---|---|
| Volatility[1] | 1 | 2 | 3 | 4 | 4 | 3 |
| Rinsability[2] | 2 | 3 | 4 | 4 | 4 | 5 |
| Lubricating Prop[3] | 2 | 3 | 3 | 4 | 4 | 3 |
| Liquidity[4] | 2 | 1 | 4 | 5 | 4 | 4 |

[1]Oven @ 200° C. for 24 hours.
[2]70° F. water wash.
[3]Rothschild Friction Tester.
[4]At 20° C.

The alkoxylated alcoholic product can be employed directly as a lubricant or these products can be converted, in whole or in part to the corresponding ester by reacting the alkoxylated alcohol with a $C_4$ to $C_{20}$ organic fatty acid as illustrated in the following examples.

EXAMPLES 12–18

To the indicated amounts of the specified alkoxylated guerbet alcohols was added the following amounts of the fatty acids reported in Table II. the ensuing esterification reactions were affected by heating to a temperature of 160°–180° C. under 5 mm Hg while distilling off water at about 140° C. The reaction was continued until an acid value less than 1 mg KOH/gram was reached. The esterified products were recovered in high purity by the continuous removal of water by-product.

TABLE II

| Ex. | Fatty Acid | Alkoxylated Guerbet |
|---|---|---|
| 12 | octanoic (748.5 g.) | Product B (1453 g.) |

TABLE II-continued

| Ex. | Fatty Acid | Alkoxylated Guerbet |
|---|---|---|
| 13 | lauric (748.5 g.) | Product C (2270 g.) |
| 14 | stearic (748.5 g.) | Product C (1613 g.) |
| 15 | coco (748.5 g.) | Product D (1690 g.) |
| 16 | caprylic (748.5 g.) | Product E (155.5 g.) |
| 17 | dimer acid mixture* (748.5 g.) | Product E (238.0 g.) |
| 18 | dimer acid mixture* (748.5 g.) | Product F (119.0 g.) |

*a mixture containing compounds L, M and O.

Of the above alkoxylated guerbet esters, only that of example 12 failed to show satisfactory liquidity and superior lubricating properties in aluminum can drawing.

The remaining products had good resistance to oxidation, were easily rinsed of an aluminum surface, possessed excellent lubricity and spraying films of the products on the metal surface showed good metal substantivity.

Other dimer acid mixtures, e.g. those of the following compositions (Table III) can be substituted in Examples 17 and 18 to provide esters having good liquidity and superior lubricating properties.

TABLE III

| FEESTOCK | ACYCLIC | MONOCYCLIC | POLY-CYCLIC |
|---|---|---|---|
| Oleic acid, elaidic acid | 40 | 55 | 5 |
| Tall oil fatty acid | 15 | 70 | 15 |
| Linoleic acid | 5 | 55 | 40 |

EXAMPLE 19

To 1815 g. of product D in Example 11 in a stirred glass reactor was added 210 g. of trimellitic acid. The mixture was heated to a temperature of 170° C. for 6 hours with agitation and $H_2O$ evaporation after which the mixture was cooled and the triester product containing mono-, di- acid and acyclic esters of compounds L, M and O was recovered. The product mixture had an acid value less than 1.5 mg KOH/g. The product showed superior metal lubricating properties, good resistance to oxidation and high metal substantivity.

EXAMPLE 20–25

The following experiments were performed with a Rothschild Friction Tester to measure and compare the frictional properties of the present compounds with others used commercially, such as Alkalube GE-3 (2-decyl-decan-1-ol of 3 EO units); Alkalube GE-5 (2-decyl-decan-1-ol of 5 EO units) and Alkalube GE-20 (2-decyl-decan-ol of 20 EO units). These commercial products were compared with the products of Examples 15, 16 and 18.

The tests were preformed by preparing in a glass burette a 1% solution of the test lubricant in isopropanol. The solution was stirred for 1 hour and allowed to stand overnight before it was introduced into an Atlab Finish Applicator from which it was applied to a polyester fiber of 150 denier and 32 fibrils in an amount of 1 wt. %/wt. of fiber. The coated fiber was passed over an Al/SS drum at 100° F. to drive off isopropanol and was then wound on a SS spool and stored for 24 hours at a constant temperature of 72° F. and 60% relative humidity. After this period of equilibration, the fiber was introduced into a Rothschild Friction Tester operated at 100 and 300 m/minutes and the friction of the fiber between 2 transducers was measured. The coefficient of friction (mu) at the fiber metal interface was recorded and is reported in following Table IV.

TABLE IV

| Example # | Product | Appearance at 22° C. | Lubrication Data (Coefficient of Friction) Fiber/Metal 100 m-300 m | Iodine Value ACOS Test Method Tg-Ia-64 | Remarks |
|---|---|---|---|---|---|
| 20 | Alkalube GE-3 | yellow liquid | 0.27-0.28 | 0.3 | product volatile - unacceptable - lacks good substantivity to metal substrate |
| 21 | Alkalube GE-5 | yellow liquid | 0.27-0.29 | 0.2 | viscous product - poor rinsability |
| 22 | Alkalube GE-20 | white paste | 0.27-0.32 | 0.1 | paste product - poor rinsability |
| 23 | Example 15 | yellow liquid | 0.23-0.24 | 0.05 | non-volatile liquid good rinsability - superior lubrication high metal substantivity |
| 24 | Example 16 | yellow liquid | 0.25-0.27 | 0.09 | non-volatile liquid - good rinsability - superior lubrication - high metal substantivity |
| 25 | Example 18 | yellow liquid | 0.27-0.28 | 0.11 | non-volatile liquid - good rinsability - superior lubrication - high metal substantivity |

What is claimed is:

1. An alkoxylated compound having the formula

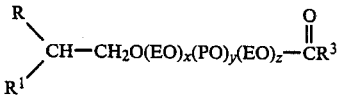

wherein R and $R^1$ are each individually alkyl of from 6 to 16 carbon atoms; y is an integer having a value of from 1 to 20; x and z are integers and the sum of x and z is 0 to 20; $R^3$ is selected from the group of alkyl or alkenyl radicals which alkyl and alkenyl are substituted with $COR^5$ or a cyclohexenyl moiety of the group

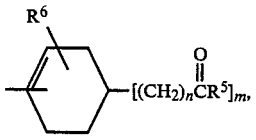

and

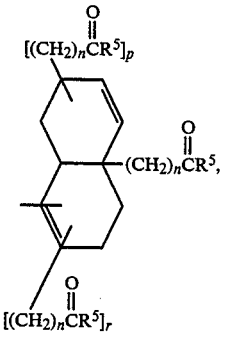

wherein m has a value of from 1 to 3; n in each instance has a value of from 0 to 10; each of p and r has a value of from 0 to 1; $R^5$ is

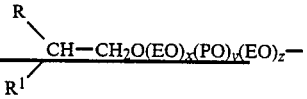

and $R^6$ is alkyl or alkenyl having from 1 to 10 carbon atoms.

2. The compound of claim 1 wherein x and/or z have a value of at least 1.

3. The compound of claim 1 having an iodine number less than 2.

4. The compound of claim 1 wherein R and $R^1$ are identical.

5. The compound of claim 1 wherein x, y and/or z each has a value of from 1 to 15.

6. The compound of claim 1 in admixture with 6-hept-1-enyl)-5-pentyl-3-cyclohexene-1,2-dinonanoic acid ester.

7. The compound of claim 1 in admixture with 5,6-(dibutyl-hexahydro-1,2-naphthalene dioctanoic acid ester.

8. The compound of claim 1 in admixture with 9-nonylidene-10-pentyl-1,18-octadecanedioic acid ester.

9. The compound of claim 1 in admixture with the lauryl ester of ethoxylated-propoxylated 2-decyl decanol.

10. The compound of claim 1 in admixture with the coco ester of propoxylated 2-decyl decanol.

11. A liquid lubricant composition resistant to oxidation and rancidity containing between about 0.05% and about 1% by weight of the compound of claim 1 and a carrier therefore selected from the group of water, mineral oil, a paraffinic oil, a fatty acid ester, a fatty acid ketone, an alkoxylated ester, an alkoxylated ketone and mixtures thereof.

12. The composition of claim 11 wherein said carrier is selected from the group of water and mineral oil and the weight ratio of carrier to compound of said alkoxylated compound is between about 20:1 and about 1:20.

13. The composition of claim 11 which additionally contains non-alkoxylated guerbet alcohol having the formula

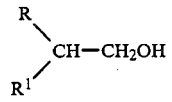

wherein R and $R^1$ are each individually alkyl of from 6 to 16 carbon atoms.

14. The composition of claim 13 wherein said non-alkoxylated guerbet alcohol is present in an amount of up to about 50% by weight.

15. The composition of claim 14 wherein said non-alkoxylated guerbet alcohol is present in an amount up to about 30% by weight.

16. A composition containing a mixture of the compound of claim 1 and a compound having the formula

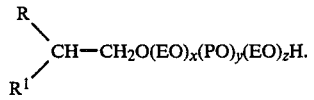

R, $R^1$, x, y, and z are as defined in claim 1.

17. The process of making the compound of claim 1 which comprises contacting a guerbet alcohol having the formula

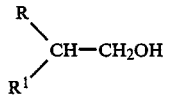

wherein R and $R^1$ are each alkyl of 6 to 16 carbon atoms with an alkylene oxide selected from the group of propylene oxide and propylene oxide and ethylene oxide in a mole ratio of alcohol to alkylene oxide of between about 1:1 and about 1:20 at a temperature of from about 85° C. to about 200° C. and esterifying the resulting alkoxylated product with an organic acid in a weight ratio of alkoxylated compound to acid of between about 1:5 and about 5:1 under vacuum at a temperature of from about 125° C. to about 250° C., said organic acid selected from the group of

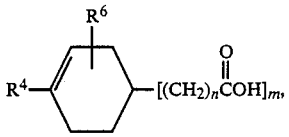

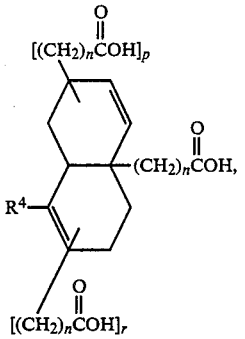

an alkyl carboxylic acid substituted with a

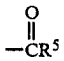

radical and an alkenyl carboxylic acid substituted with a

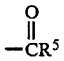

radical; where $R^4$ is alkyl or alkenyl having from 1 to 15 carbon atoms and R, $R^1$, $R^5$, $R^6$, m, n, p, and r are as defined in claim 1.

18. The process of claim 17 wherein the guerbet alcohol is first contacted with EO and is then contacted with PO to provide the alcoholic alkoxylated product of claim 1 having a substantially block structure wherein the sum of x and z is 1 to 20 and y has a value of 1 to 15.

19. The process of claim 17 wherein the guerbet alcohol is contacted with EO and PO in admixture and a product of heteric structure is obtained.

20. The process of claim 17 wherein the guerbet alcohol is contacted with only PO.

21. The process of claim 17 wherein said organic acid is a mono carboxylic acid.

22. The process of claim 17 wherein said organic acid is a dicarboxylic acid.

23. The process of claim 17 wherein said organic acid is a tricarboxylic acid.

* * * * *